US011802493B2

(12) United States Patent
Gostomelsky et al.

(10) Patent No.: US 11,802,493 B2
(45) Date of Patent: Oct. 31, 2023

(54) OUTLET GUIDE VANE ASSEMBLY IN GAS TURBINE ENGINE

(71) Applicant: Siemens Energy Global GmbH & Co. KG, Munich (DE)

(72) Inventors: Alexander Gostomelsky, Orlando, FL (US); Dimitri Zelmer, Oberhausen (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 51 days.

(21) Appl. No.: 17/597,125

(22) PCT Filed: Apr. 24, 2020

(86) PCT No.: PCT/US2020/029672
§ 371 (c)(1),
(2) Date: Dec. 27, 2021

(87) PCT Pub. No.: WO2020/263394
PCT Pub. Date: Dec. 30, 2020

(65) Prior Publication Data

US 2022/0243618 A1 Aug. 4, 2022

Related U.S. Application Data

(60) Provisional application No. 62/867,983, filed on Jun. 28, 2019.

(51) Int. Cl.
*F01D 25/24* (2006.01)
*F01D 9/04* (2006.01)

(52) U.S. Cl.
CPC ..... *F01D 25/246* (2013.01); *F01D 9/042* (2013.01); *F05D 2220/3212* (2013.01);
(Continued)

(58) Field of Classification Search
CPC ..... F01D 25/243; F01D 25/246; F01D 9/041; F01D 9/042; F01D 11/005;
(Continued)

(56) References Cited

U.S. PATENT DOCUMENTS 6,179,560 B1 1/2001 Kouris et al.
2009/0191053 A1* 7/2009 Bridge ..... F01D 5/225 415/208.2
(Continued)

FOREIGN PATENT DOCUMENTS

EP 1790828 A2 5/2007
EP 2354459 A2 8/2011

OTHER PUBLICATIONS

PCT International Search Report and Written Opinion of International Searching Authority dated Jul. 28, 2020 corresponding to PCT International Application No. PCT/US2020/029672 filed Apr. 24, 2020.

*Primary Examiner* — Loren C Edwards

(57) ABSTRACT

An outlet guide vane assembly in a gas turbine engine is presented. The outlet guide vane assembly includes an inner shroud and an outlet guide vane having an inner platform. The inner shroud has a flange arranged at aft side that is bolted to a flange of the inner platform arranged at forward side. The inner shroud flange has a protrusion that engages a recess of the inner platform flange forming a form fit connection interface between the inner shroud and the outlet guide vane. The inner platform has shiplaps arranged at two circumferential sides that overlap shiplaps of an adjacent inner platform forming a form fit connection interface between adjacent outlet guide vanes. The outlet guide vane assembly includes a plurality of segments circumferentially arranged. Each segment includes a plurality of outlet guide vanes assembled to an inner shroud.

20 Claims, 3 Drawing Sheets

(52) U.S. Cl.
CPC ..... *F05D 2230/60* (2013.01); *F05D 2240/11* (2013.01); *F05D 2240/12* (2013.01); *F05D 2240/35* (2013.01); *F05D 2240/80* (2013.01); *F05D 2260/31* (2013.01); *F05D 2260/36* (2013.01)

(58) Field of Classification Search
CPC ..... F05D 2220/3212; F05D 2230/60; F05D 2240/11; F05D 2240/12; F05D 2240/35; F05D 2240/80; F05D 2260/31; F05D 2260/36
See application file for complete search history.

(56) References Cited

U.S. PATENT DOCUMENTS

| | | | | |
|---|---|---|---|---|
| 2018/0195403 | A1 | 7/2018 | Kerns et al. | |
| 2020/0318652 | A1* | 10/2020 | McCaffrey | F01D 9/04 |

* cited by examiner

OUTLET GUIDE VANE ASSEMBLY IN GAS TURBINE ENGINE

TECHNICAL FIELD OF THE INVENTION

This invention relates generally to an outlet guide vane assembly in a gas turbine engine.

DESCRIPTION OF THE RELATED ART

An industrial gas turbine engine typically includes a compressor section, a turbine section, and a mid-frame section disposed therebetween. The compressor section includes multiple stages of compressor blades and vanes and an outlet guide vane assembly aft of the last stage blade and vane. The mid-frame section typically includes a compressor exit diffusor and a combustor assembly. The compressor exit diffusor diffuses the compressed air from the compressor section into a plenum through which the compressed air flows to a combustor assembly which mixes the compressed air with fuel and ignites the mixture and transits the ignited mixture to the turbine section for mechanical power. The turbine section includes multiple stages of turbine blades and vanes.

There is an increasing demand for higher efficiencies and power ranges of gas turbine engines. Such demand leads to larger radial temperature gradients and thermal deflections of components, especially at compressor rear stages. These circumstances make it challenging to keep radial clearances between tips of compressor vanes and compressor inner annuals small. A small radial clearance between tips of compressor vanes and compressor inner annuals is important to achieve both higher efficiency and stability of the compressor.

SUMMARY OF THE INVENTION

Briefly described, aspects of the present invention relate to a gas turbine engine, an outlet guide vane assembly in a gas turbine engine, and a method for assembling an outlet guide vane assembly in a gas turbine engine.

According to an aspect, a gas turbine engine is presented. The gas turbine engine comprises a compressor section comprising an outlet guide vane assembly. The gas turbine engine comprises a mid-frame section arranged downstream of the compressor section. The mid-frame section comprises an inner compressor exit diffuser. A forward side of the inner compressor exit diffuser interfaces with the outlet guide vane assembly. The gas turbine engine comprises a turbine section arranged downstream of the mid-frame section. The outlet guide vane assembly comprises an inner shroud comprising a circular shape and extending axially. The outlet guide vane assembly comprises an outlet guide vane comprising an airfoil radially extending between an airfoil root and an inner platform. The inner shroud comprises a flange arranged at an aft side and extending radially downwardly. The inner platform comprises a flange arranged at a forward side and extending radially downwardly. The outlet guide vane is connected to the inner shroud at an interface of the inner platform flange and the inner shroud flange.

According to an aspect, an outlet guide vane assembly in a gas turbine is presented. The outlet guide vane assembly comprises an inner shroud comprising a circular shape and extending axially. The outlet guide vane assembly comprises an outlet guide vane comprising an airfoil radially extending between an airfoil root and an inner platform. The inner shroud comprises a flange arranged at an aft side and extending radially downwardly. The inner platform comprises a flange arranged at a forward side and extending radially downwardly. The outlet guide vane is connected to the inner shroud at an interface of the inner platform flange and the inner shroud flange. According to an aspect, a method for assembling an outlet guide vane assembly in a gas turbine engine is presented. The gas turbine engine comprises an inner compressor exit diffuser. A forward side of the inner compressor exit diffuser interfaces the outlet guide vane assembly. The method comprises providing an inner shroud comprising a circular shape and extending axially. The inner shroud comprises a flange arranged at an aft side and extending radially downwardly. The method comprises providing an outlet guide vane comprising an airfoil radially extending between an airfoil root and an inner platform. The inner platform comprises a flange arranged at a forward side and extending radially downwardly. The method comprises connecting the outlet guide vane to the inner shroud at an interface of the inner platform flange and the inner shroud flange.

Various aspects and embodiments of the application as described above and hereinafter may not only be used in the combinations explicitly described, but also in other combinations. Modifications will occur to the skilled person upon reading and understanding of the description.

BRIEF DESCRIPTION OF THE DRAWINGS

Exemplary embodiments of the application are explained in further detail with respect to the accompanying drawings. In the drawings.

To facilitate understanding, identical reference numerals have been used, where possible, to designate identical elements that are common to the figures.

DETAILED DESCRIPTION OF THE INVENTION

A detailed description related to aspects of the present invention is described hereafter with respect to the accompanying figures.

For illustration purpose, term "axial" or "axially" refers to a direction along a longitudinal axis of a gas turbine engine, term "radial" or "radially" refers to a direction perpendicular to the longitudinal axis of the gas turbine engine, term "downstream" or "aft" refers to a direction along a flow direction, term "upstream" or "forward" refers to a direction against the flow direction.

Figure 1:
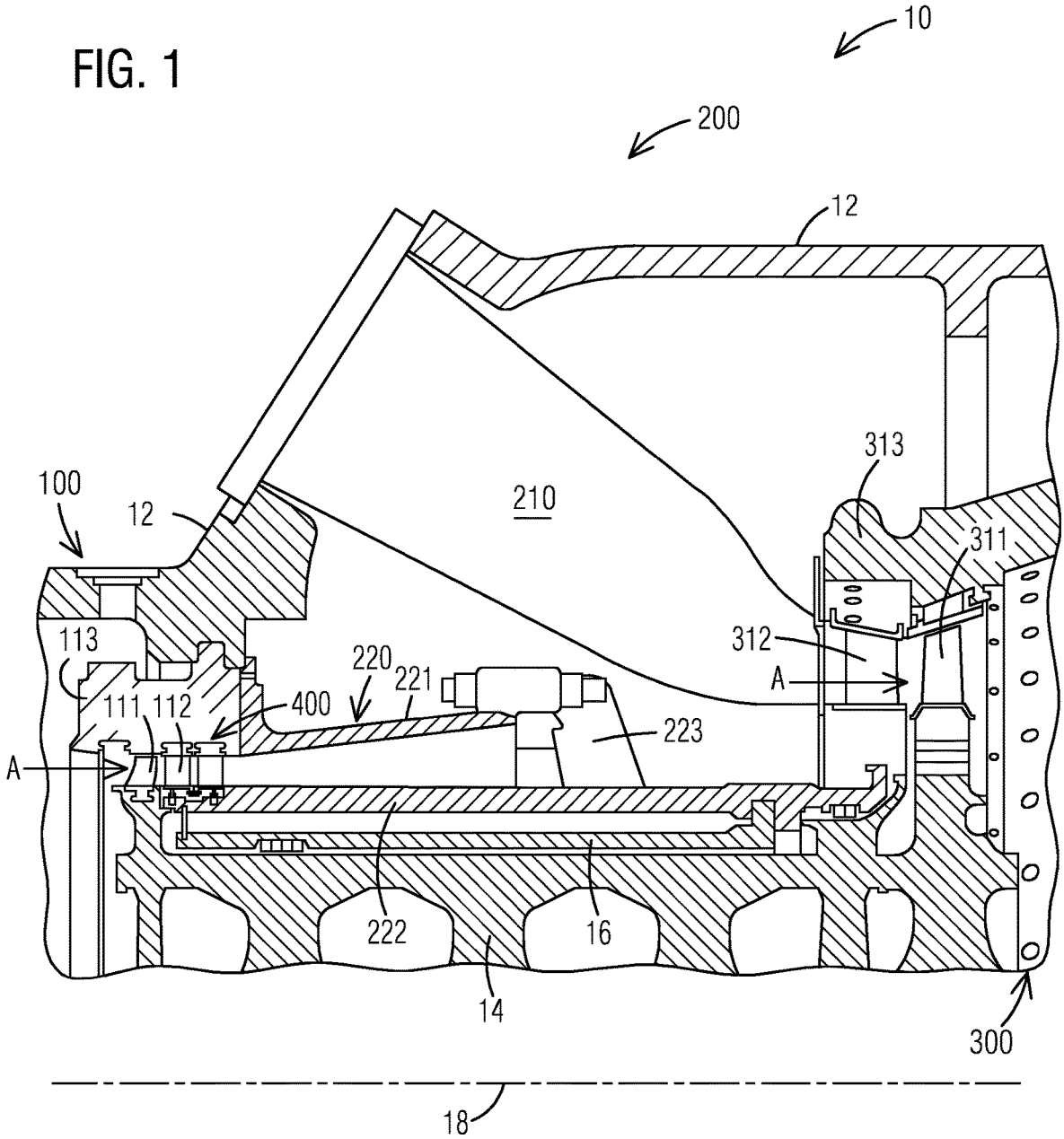
FIG. 1 is a schematic longitudinal section view of a portion of a gas turbine engine according to an embodiment of the present invention.

FIG. 1 illustrates a schematic longitudinal section view of a portion of a gas turbine engine 10 according to an embodiment of the present invention. As illustrated in FIG. 1, the gas turbine engine 10 includes a plurality of components along a longitudinal axis 18. The plurality of components may include a compressor section 100, a turbine section 300 located downstream of the compressor section 100 with respect to a flow direction A, and a mid-frame section 200 that is located there between. The gas turbine engine 10 also includes an outer casing 12 that encloses the plurality of components. A rotor 14 longitudinally connects the compressor section 100, the mid-frame section 200 and the turbine section 300 and is circumferentially enclosed thereby. The rotor 14 may be partially or fully enclosed by a shaft cover 16.

The compressor section 100 includes multiple stages of compressor rotating blades 111 and compressor stationary vanes 112. FIG. 1 only shows the last stage of compressor rotating blade 111 and compressor stationary vane 112. An outlet guide vane assembly 400 is arranged downstream of the last stage compressor vane 112. The compressor blades 111 are installed into the rotor 14. The compressor vanes 112 and the outlet guide vane assembly 400 are installed into a compressor vane carrier 113. The compressor vane carrier 113 interfaces with the outer casing 12. The turbine section 300 includes multiple stages of turbine stationary vanes 312 and turbine rotating blades 311. FIG. 1 only shows the first stage of turbine stationary vane 312 and turbine rotating blade 311. The turbine vanes 312 are installed into a turbine vane carrier 313. The turbine vane carrier 313 interfaces with the outer casing 12. The turbine blades 311 are installed into the rotor 14. The mid-frame section 200 typically includes a combustor assembly 210 and a compressor exit diffuser 220. The compressor exit diffuser 220 is located downstream of the outlet guide vane assembly 400.

The compressor exit diffusor 220 typically includes an outer compressor exit diffusor 221 and an inner compressor exit diffusor 222. The outer compressor exit diffusor 221 is connected to the inner compressor exit diffusor 222 by bolting to a strut 223. The inner compressor exit diffusor 222 may enclose the shaft cover 16. Forward side of the outer compressor exit diffusor 221 interfaces with the outer casing 12. Forward side of the inner compressor exit diffusor 222 interfaces with the last stage compressor vane 112 and the outlet guide vane assembly 400.

In operation of the gas turbine engine 10, the compressor section 100 inducts air via an inlet duct (not shown). The air is compressed and accelerated in the compressor section 100 while passing through the multiple stages of compressor rotating blades 111 and compressor stationary vanes 112, as indicated by the flow direction A. The compressed air passes through the outlet guide vane assembly 400 and enters the compressor exit diffuser 220. The compressor exit diffuser 200 diffuses the compressed air to the combustor assembly 210. The compressed air is mixed with fuel in the combustor assembly 210. The mixture is ignited and burned in the combustor assembly 210 to form a combustion gas. The combustion gas enters the turbine section 300, as indicated by the flow direction A. The combustion gas is expanded in the turbine section 300 while passing through the multiple stages of turbine stationary vanes 312 and turbine rotating blades 311 to generate mechanical power which drives the rotor 14. The rotor 14 may be linked to an electric generator (not shown) to convert the mechanical power to electrical power. The expanded gas constitutes exhaust gas and exits the gas turbine engine 10.

Figure 2:
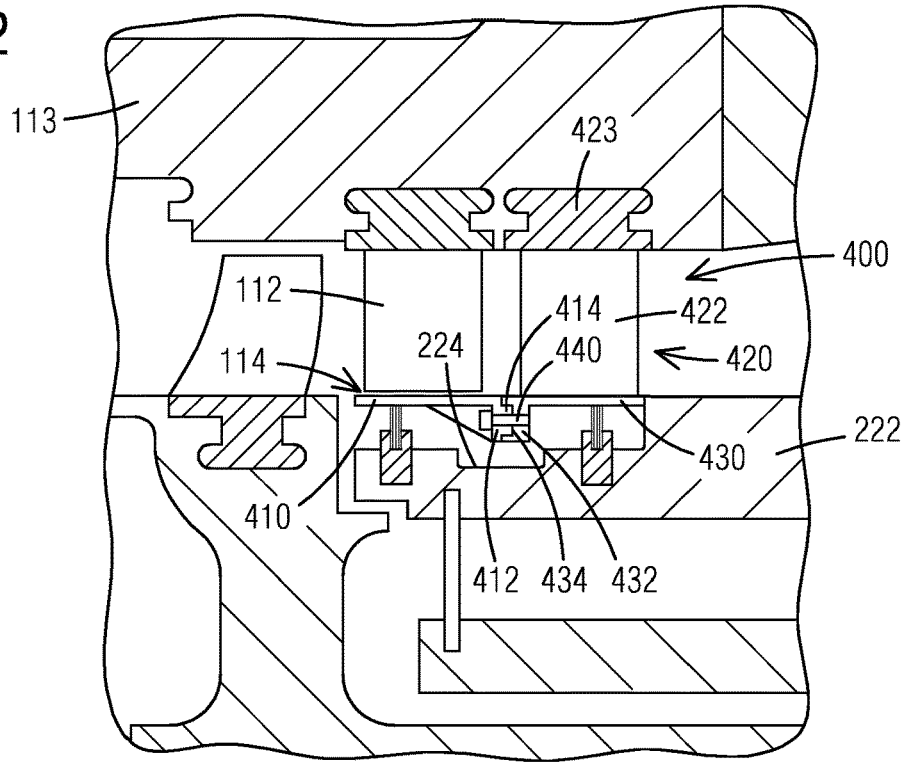
FIG. 2 is a schematic longitudinal section view of a compressor outlet guide vane assembly in a gas turbine engine according to an embodiment of the present invention.

FIG. 2 is a schematic longitudinal section view of an outlet guide vane assembly 400 in a gas turbine engine 10 according to an embodiment of the present invention. As shown in the exemplary embodiment of FIG. 2, the outlet guide vane assembly 400 includes an inner shroud 410 and an outlet guide vane 420 that are assembled together. The inner shroud 410 and an outlet guide vane 420 may be assembled together by any suitable means, such as by a bolt 440. The outlet guide vane 420 includes an airfoil 422 extending radially between an airfoil root 423 and an inner platform 430. The airfoil 422, the airfoil root 423 and the inner platform 430 may be manufactured as an integral piece. The airfoil root 423 is installed into the compressor vane carrier 113. The inner shroud 410 extends axially. A radial clearance 114 exists between tip of the last stage compressor vane 112 and the inner shroud 410.

Figure 3:
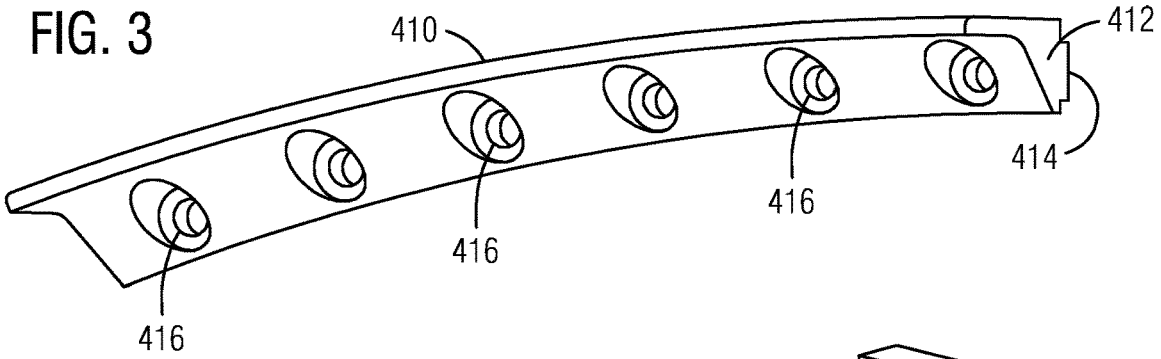
FIG. 3 is a schematic perspective view of an inner shroud of a compressor outlet guide vane assembly according to an embodiment of the present invention.

FIG. 3 is a schematic perspective view of an inner shroud 410 according to an embodiment of the present invention. As shown in the exemplary embodiment of FIG. 3, the inner should 410 may have a circular shape and extends axially. The inner shroud 410 has a flange 412. The inner shroud flange 412 is arranged at an aft side of the inner shroud 410 and extends radially downwardly. The inner shroud flange 412 provides an interface to the outlet guide vane 420 for assembly. The inner shroud flange 412 has a protrusion 414. The protrusion 414 is arranged at an aft side of the inner shroud flange 412 and extends axially. Height of the protrusion 414 is less than height of the inner shroud flange 412. Upper side of the protrusion 414 steps down from upper side of the inner shroud flange 412. Bottom side of the protrusion 414 steps up from bottom side of the inner shroud flange 412. The inner shroud 410 may have at least a hole 416 axially penetrating through the inner shroud flange 412 and the protrusion 414. The hole 416 may be a threaded bore hole for threading a bolt 440.

Figure 4:
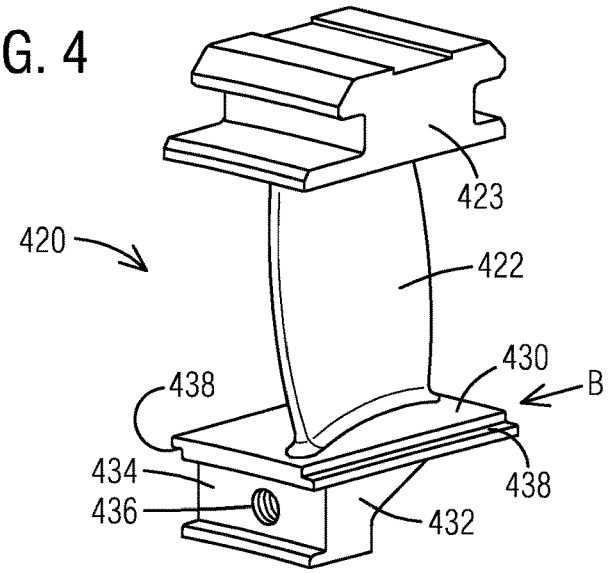
FIG. 4 is a schematic perspective view of a compressor outlet guide vane of a compressor outlet guide vane assembly according to an embodiment of the present invention.

FIG. 4 is a schematic perspective view the of an outlet guide vane 420 according to an embodiment of the present invention. As shown in the exemplary embodiment of FIG. 4, the outlet guide vane 420 has an inner platform 430. The inner platform 430 has a flange 432. The inner platform flange 432 is arranged at a forward side of the inner platform 430 and extends radially downwardly. The inner platform flange 432 provides a mating interface to the inner shroud 410 for assembly. The inner platform flange 432 has a recess 434. The recess 434 is arranged at a forward side of the inner platform flange and recesses axially. The recess 434 may have a C-shape. The inner platform flange 432 may have a hole 426 axially penetrating through the inner platform flange 432. The hole 436 may be located at a center position of the recess 434. The hole 436 may be a threaded bore hole for threading a bolt 440.

Referring to FIG. 2, the outlet guide vane 420 is assembled to the inner shroud 410 to form the outlet guide vane assembly 400. A bolt 440 extends axially through the hole 436 at the inner platform flange 432 and the hole 416 at the inner shroud flange 412 to form a bolted connection. FIGS. 2 to 4 are for illustration purpose only. It is understood that any suitable connection means known in the industry may be used to connect the outlet guide vane 420 to the inner shroud 410.

The protrusion 414 of the inner shroud 410 engages the recess 434 of the inner platform 430. The inner shroud 410 is thus positioned in radial direction and axially direction. The protrusion 414 and the recess 434 may be dimensioned to provide a tight fit against each other. The engagement of the protrusion 414 and the recess 434 forms a form fit connection interface between the inner shroud 410 and the outlet guide vane 420. The form fit connection interface may allow enough displacement between the inner shroud 410 and the outlet guide vane 420 for compensating thermal expansions while positioning the inner shroud 410 and the outlet guide vane 420 radially and axially. The form fit connection interface between the protrusion 414 and the recess 434 has large enough contact area to minimize local contact stress concentration which results in less wear and a longer product life.

Figure 5:
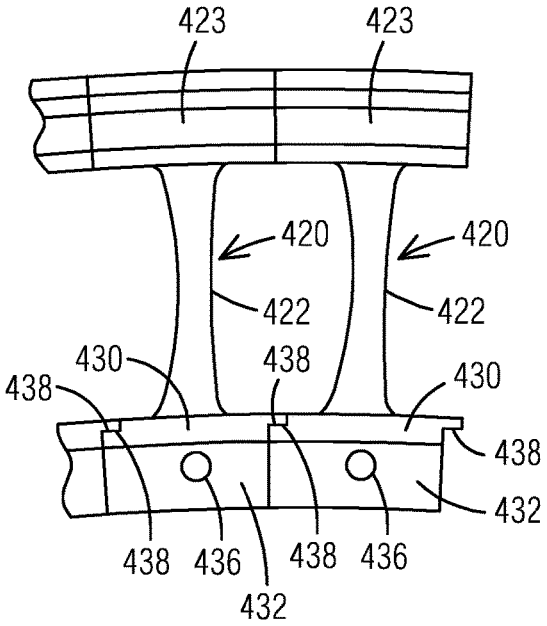
FIG. 5 is a schematic diagram of a compressor outlet guide vane assembly looking into an upstream direction B in FIG. 4 according to an embodiment of the present invention.
Figure 6:
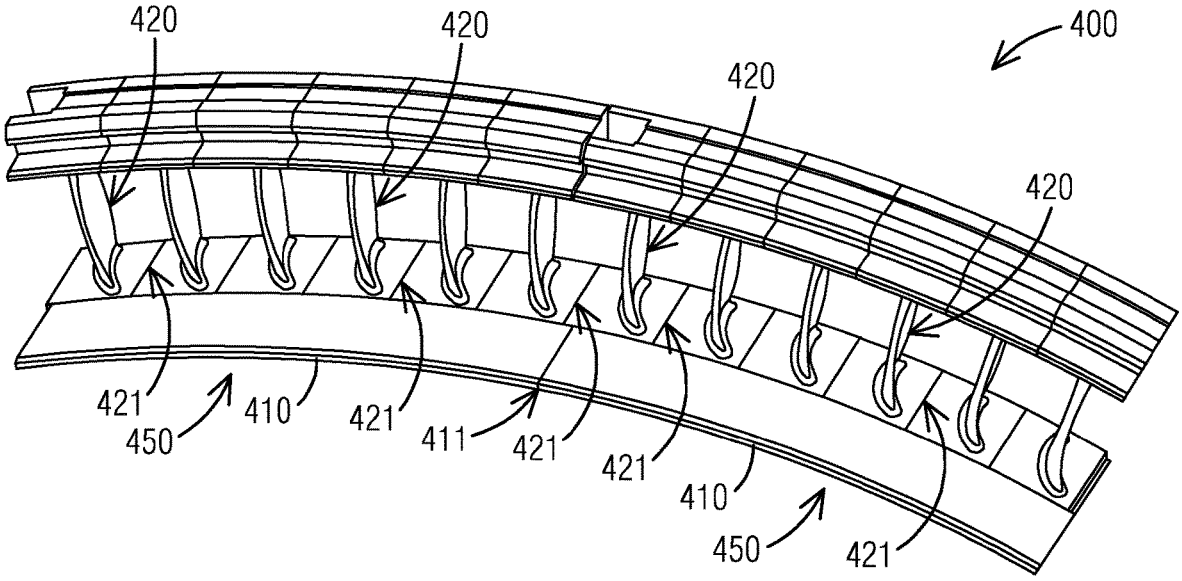
FIG. 6 is a schematic diagram of a compressor outlet guide vane assembly having segments according to an embodiment of the present invention.

As shown in the exemplary embodiment of FIG. 4, the inner platform 430 may include shiplaps 438. The shiplaps 438 are steps arranged at two circumferential sides of the inner platform 430. The shiplaps 438 provides an overlapping interface to an adjacent outlet guide vane 420 for assembly. FIG. 5 is a schematic diagram of an outlet guide vane assembly 400 looking into an upstream direction B in FIG. 4. As shown in the exemplary embodiment of FIG. 5, the adjacent outlet guide vanes 420 are circumferentially overlapped at the shiplaps 438 to form a form fit connection interface. The form fit connection interface may allow enough displacement between the adjacent outlet guide vanes 420 for compensating thermal expansions while positioning the adjacent outlet guide vanes 420 circumferentially. The form fit connection interface between the adjacent outlet guide vanes 420 has large enough contact area to minimize local contact stress concentration which results in less wear and a longer product life Referring to FIG. 3, the inner shroud 410 has a circular shape. The inner shroud 410 may have a plurality of holes 416. A plurality of outlet guide vanes 420 may be assembled to the inner shroud 410 to form an outlet guide vane assembly segment 450. FIG. 6 is a schematic diagram of an outlet guide vane assembly 400 having an outlet guide vane assembly segment 450 according to an embodiment of the present invention. As shown in the exemplary embodiment of FIG. 6, the outlet guide vane assembly segment 450 includes a plurality of outlet guide vanes 420 assembled to the inner shroud 410. The outlet guide vanes 420 may be assembled to the inner shroud 410 using bolted connections, as shown in FIG. 2. The outlet guide vanes 420 may also form fit to the inner shroud 410 using protrusions 414 and the recesses 434. Adjacent outlet guide vanes 420 may form fit to each other using the overlapped shiplaps 438. For illustration purpose, FIG. 3 and FIG. 6 shows six outlet guide vanes 420 assembled to the inner shroud 410. It is understood that any desired numbers of outlet guide vanes 420 may be connected to the inner shroud 410.

The outlet guide vane assembly 400 may include a plurality of outlet guide vane assembly segments 450. As shown in the exemplary embodiment of FIG. 6, the plurality of outlet guide vane assembly segments 450 may be circumferentially arranged to enclose the inner compressor exit diffusor 222. For illustration purpose, only two outlet guide vane assembly segments 450 are shown in FIG. 6. A circumferential gap 411 may exist between adjacent outlet guide vane assembly segments 450. A circumferential gap 421 may exist between adjacent outlet guide vanes 420. The gap 411 and the gap 421 may compensate for thermal expansion.

Referring to FIG. 2, the inner compressor exit diffusor 222 may step down at the forward side for accommodating the outlet guide vane assembly 400. The inner compressor exit diffusor 222 may have a recess 224 for adapting the connected inner shroud flange 412 and the inner platform flange 432 when assembling the outlet guide vane assembly 400 into the gas turbine engine 10. The recess 224 may have a C-shape. During assembly, the connected inner shroud flange 412 and the inner platform flange 432 of the outlet guide vane assembly 400 slide along the recess 224 on the inner compressor exit diffusor 222 in a circumferential direction. The airfoil roots 423 of the outlet guide vane assembly 400 slide into the compressor vane carrier 113.

According to an aspect, the proposed outlet guide vane assembly 400 may allow simple assembly. The outlet guide vane assembly 400 is assembled using bolted connections and form fit connection interfaces. The outlet guide vane assembly 400 may thus eliminates requirements of special machines and/or expensive techniques for assembly.

According to an aspect, the proposed outlet guide vane assembly 400 may be easy to use during operation. The inner shroud 410 and the outlet guide vane 420 of the outlet guide vane assembly 400 are easy to be replaced. The outlet guide vane assembly segments 450 of the outlet guide vane assembly 400 are easy to be replaced. The outlet guide vane assembly 400 do not require welding, brazing or staking for assembly.

According to an aspect, the proposed outlet guide vane assembly 400 uses form fit connection interfaces in an axially direction between the inner shroud 410 and the outlet guide vane 420 and in a circumferential direction between adjacent outlet guide vanes 420. The form fit connection interface may allow enough displacement for compensating thermal expansions. The form fit connection interfaces have large enough contact area. The large contact area may minimize local contact stress concentration which results less wear and a longer product life.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

REFERENCE LIST

10: Gas Turbine Engine
12: Outer Casing
14: Rotor
16: Shaft Cover
18: Longitudinal Axis
100: Compressor Section
111: Compressor Blade
112: Compressor Vane
113: Compressor Vane Carrier
114: Radial Clearance
200: Mid-Frame Section
210: Combustor Assembly
220: Compressor Exit Diffusor
221: Outer Compressor Exit Diffusor

222: Inner Compressor Exit Diffusor
223: Strut
224: Recess on Inner Compressor Diffusor
300: Turbine Section
311: Turbine Blade
312: Turbine Vane
313: Turbine Vane Carrier
400: Outlet Guide Vane Assembly
410: Inner Shroud
411: Gap between Inner Shrouds
412: Inner Shroud Flange
414: Inner Shroud Protrusion
416: Holes on Inner Shroud
420: Outlet Guide Vane
421: Gap between Outlet Guide Vanes
422: Airfoil
423: Airfoil Root
430: Inner Platform
432: Inner Platform Flange
434: Recess on Inner Platform Flange
436: Hole on Inner Platform Flange
438: Shiplap on Inner Platform
440: Bolt
450: Outlet Guide Vane Assembly Segment

What is claimed is:

1. A gas turbine engine comprising:

a compressor section comprising an outlet guide vane assembly;

a mid-frame section arranged downstream of the compressor section, wherein the mid-frame section comprises an inner compressor exit diffuser, wherein a forward side of the inner compressor exit diffuser interfaces with the outlet guide vane assembly; and a turbine section arranged downstream of the mid-frame section, wherein the outlet guide vane assembly comprises:

an inner shroud comprising a circular shape and extending axially, and an outlet guide vane comprising an airfoil radially extending between an airfoil root and an inner platform, wherein the inner shroud comprises a flange arranged at an aft side and extending radially downwardly, wherein the inner platform comprises a flange arranged at a forward side and extending radially downwardly, and wherein the outlet guide vane is connected to the inner shroud at an interface of the inner platform flange and the inner shroud flange such that a radial clearance exists between a tip of a last stage compressor vane and the inner shroud.

2. The gas turbine engine as claimed in claim 1, wherein the outlet guide vane is connected to the inner shroud using a bolt extending axially in the inner platform flange and the inner shroud flange.

3. The gas turbine engine as claimed in claim 1, wherein the inner shroud flange comprises a protrusion arranged at an aft side of the inner shroud flange, wherein the inner platform flange comprises a recess arranged at a forward side of the inner platform flange configured to engage the protrusion, and wherein the protrusion and the recess are configured to form a form fit connection interface between the inner shroud and the outlet guide vane.

4. The gas turbine engine as claimed in claim 1, wherein the outlet guide vane assembly comprises an outlet guide vane assembly segment, and wherein the outlet guide vane assembly segment comprises a plurality of outlet guide vanes connected to the inner shroud.

5. The gas turbine engine as claimed in claim 4, wherein the outlet guide vane assembly comprises a plurality of outlet guide vane assembly segments arranged circumferentially.

6. The gas turbine engine as claimed in claim 4, wherein the inner platform comprises shiplaps arranged at two circumferential sides, and wherein the shiplaps are configured to form a form fit connection interface between adjacent outlet guide vanes.

7. The gas turbine engine as claimed in claim 1, wherein the inner compressor exit diffusor comprises a recess to receive the connected inner platform flange and the inner shroud flange in the recess.

8. An outlet guide vane assembly in a gas turbine engine comprising:

an inner shroud comprising a circular shape and extending axially, and an outlet guide vane comprising an airfoil radially extending between an airfoil root and an inner platform, wherein the inner shroud comprises a flange arranged at an aft side and extending radially downwardly, wherein the inner platform comprises a flange arranged at a forward side and extending radially downwardly, and wherein the outlet guide vane is connected to the inner shroud at an interface of the inner platform flange and the inner shroud flange such that a radial clearance exists between a tip of a last stage compressor vane and the inner shroud.

9. The outlet guide vane assembly as claimed in claim 8, wherein the outlet guide vane is connected to the inner shroud using a bolt extending axially in the inner platform flange and the inner shroud flange.

10. The outlet guide vane assembly as claimed in claim 8, wherein the inner shroud flange comprises a protrusion arranged at an aft side of the inner shroud flange, wherein the inner platform flange comprises a recess arranged at a forward side of the inner platform flange configured to engage the protrusion, and wherein the protrusion and the recess are configured to form a form fit connection interface between the inner shroud and the outlet guide vane.

11. The outlet guide vane assembly as claimed in claim 8, wherein the outlet guide vane assembly comprises an outlet guide vane assembly segment, and wherein the outlet guide vane assembly segment comprises a plurality of outlet guide vanes connected to the inner shroud.

12. The outlet guide vane assembly as claimed in claim 11, wherein the outlet guide vane assembly comprises a plurality of outlet guide vane assembly segments arranged circumferentially.

13. The outlet guide vane assembly as claimed in claim 11, wherein the inner platform comprises shiplaps arranged at two circumferential sides, and wherein the shiplaps are configured to form a form fit connection interface between adjacent outlet guide vanes.

14. A method for assembling an outlet guide vane assembly in a gas turbine engine, wherein the gas turbine engine comprises an inner an inner compressor exit diffuser, wherein a forward side of the inner compressor exit diffuser interfaces the outlet guide vane assembly, the method comprising:

providing an inner shroud comprising a circular shape and extending axially, wherein the inner shroud comprises a flange arranged at an aft side and extending radially downwardly, and providing an outlet guide vane comprising an airfoil radially extending between an airfoil root and an inner platform, wherein the inner platform comprises a flange arranged at a forward side and extending radially downwardly, and connecting the outlet guide vane to the inner shroud at an interface of the inner platform flange and the inner shroud flange such that a radial clearance exists between a tip of a last stage compressor vane and the inner shroud.

15. The method as claimed in claim 14, wherein the outlet guide vane is connected to the inner shroud by axially extending a bolt in the inner platform flange and the inner shroud flange.

16. The method as claimed in claim 14, wherein the inner shroud flange comprises a protrusion arranged at an aft side of the inner shroud flange, wherein the inner platform flange comprises a recess arranged at a forward side of the inner platform flange, and wherein the method further comprises forming a form fit connection interface between the inner shroud and the outlet guide vane by engaging the protrusion and the recess.

17. The method as claimed in claim 14, further comprising forming an outlet guide vane assembly segment comprising a plurality of outlet guide vanes connected to the inner shroud.

18. The method as claimed in claim 17, further comprising forming a plurality of outlet guide vane assembly segments arranged circumferentially.

19. The method as claimed in claim 17, wherein the inner platform comprises shiplaps arranged at two circumferential sides, and wherein the method further comprises forming a form fit connection interface between adjacent outlet guide vanes at the shiplaps.

20. The method as claimed in claim 14, wherein the inner compressor exit diffusor comprises a recess, and wherein the method further comprises receiving the connected inner platform flange and the inner shroud flange in the recess and sliding the connected inner platform flange and the inner shroud flange along the recess.

* * * * *